US006669326B2

(12) United States Patent
Yazawa et al.

(10) Patent No.: US 6,669,326 B2
(45) Date of Patent: Dec. 30, 2003

(54) INK-JET RECORDING APPARATUS

(75) Inventors: Takeshi Yazawa, Kanagawa (JP); Hitoshi Sugimoto, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/984,359

(22) Filed: Oct. 30, 2001

(65) Prior Publication Data

US 2002/0075351 A1 Jun. 20, 2002

(30) Foreign Application Priority Data

Nov. 1, 2000 (JP) ..... 2000-334518

(51) Int. Cl.[7] ..... B41J 2/165
(52) U.S. Cl. ..... 347/23
(58) Field of Search ..... 347/23, 29, 30, 347/14, 35, 33, 32

(56) References Cited

U.S. PATENT DOCUMENTS 4,692,777 A 9/1987 Hasumi ..... 346/140 R
5,495,271 A * 2/1996 Koitabashi et al. ..... 347/23
5,831,646 A * 11/1998 Kuronuma et al. ..... 347/30
5,949,447 A * 9/1999 Arai et al. ..... 347/23
6,142,600 A * 11/2000 Takahashi et al. ..... 347/23
6,231,156 B1 * 5/2001 Ono ..... 347/24

FOREIGN PATENT DOCUMENTS

JP 9-267481 10/1997
JP 9-290517 11/1997

* cited by examiner

*Primary Examiner*—Shih-Wen Hsieh
(74) *Attorney, Agent, or Firm*—Fitzpatrick, Cella, Harper & Scinto

(57) ABSTRACT

An ink-jet recording apparatus having first eject ports ejecting a first ink; second eject ports ejecting a second ink; a recovery means for executing recovery treatments respectively against the first and second eject ports; and a controlling means for controlling the recovery means to execute sucking treatments against corresponding eject ports whenever elapsed times in respective first and second eject ports after the most recent recovery treatments against respective first and second eject ports by the recovery means exceed respective predetermined threshold times, where the predetermined threshold time for the second eject ports is set at an integral which is more than two times the predetermined threshold time for the first eject ports.

11 Claims, 3 Drawing Sheets

Note:

(a) Conventional sucking schedule (b) Example of sucking schedule according to the present invention (c) Other example of sucking schedule according to the present invention Note:

(a) Conventional sucking schedule (b) Example of sucking schedule according to the present invention (c) Other example of sucking schedule according to the present invention Note :

tk : elapsed time after the last sucking of black ink tc : elapsed time after the last sucking of color inks

INK-JET RECORDING APPARATUS

BACKGROUND OF THE INVENTION

1. Field of the Invention

The present invention relates to an ink-jet recording apparatus, which forms an image by ejecting ink from a recording head onto a medium to be recorded.

2. Brief Description of the Related Art

In a recording apparatus (printer) where ink is ejected from ink eject nozzles (eject ports, eject portion) and is deposited onto a facing recording medium, the following phenomena, which result in poor printing quality, some times happen. (1) Generated bubbles are gradually accumulating in ink nozzles as a print operating time elapses. (2) Inks in nozzles are thickened as a print operating time elapses. In order to eliminate these phenomena, a method where ink is forcibly sucked for recovering, is employed for enabling printing operations. Since a large amount of ink is discharged in sucking recovery operations, sucking frequency should be kept as few as possible so as to suppress wasted volume of ink. For that purpose, timers are arranged in conventional printer apparatuses so that elapsed times after sucking operations are executed are measured and timings for sucking operations are decide according to the measured elapsed time. Recently, pigments have been being used in place of conventionally used dyes as coloring materials for black inks in order to improve quality of the black color.

However, even in the case of the above-mentioned example where inks with different properties, i.e. a pigment as the black color material and dyes as other color materials are employed, threshold times set by timers for controlling sucking operations are equal in black and color inks, though the black ink made from the pigment tends to be stuck and thickened compared with color inks made from dyes. Consequently, since threshold times are set according to properties of the black color, which apt to be thickened, sometimes color inks are sucked before sucking recovery operations are required, as a result, color inks are wasted.

SUMMARY OF THE INVENTION

The present invention is carried out in view of the above-mentioned problems and the objective of the present invention is to provide an ink-jet recording apparatus capable of reducing wasted ink and at the same time suppressing a frequency of recovery treatments.

(1) An ink-jet recording apparatus comprising: a recovery means for executing recovery treatment respectively for a first eject port for ejecting first ink and a second eject port for ejecting second ink different from the first ink; and a control means for causing the recovery means to execute recovery treatment for the first eject port and/or the second eject port which corresponding elapsed time after the recovery means executes a most recent recovery treatment exceeds respective predetermined threshold times peculiar to the respective first eject port and second eject port, where: the predetermined threshold time for the first eject port is set at nearly natural number times as long as the predetermined threshold time for the second eject port, the natural number being two or more.

(2) The ink-jet recording apparatus according to (1), where: the first eject port is provide to a color head unit for ejecting color ink as the first ink; and the second eject port is provided to a black unit head for ejecting black ink as the second ink.

(3) The ink-jet recording apparatus according to (1), where: the first ink includes dye as coloring material; and the second ink includes pigment as coloring material.

(4) The ink-jet recording apparatus according to (1), where: the recovery means executes recovery treatment when data for recording is received.

(5) The ink-jet recording apparatus according to (1), where: electro-thermal converting bodies for generating thermal energy to be utilized to eject ink are arranged corresponding to the respective first eject port and second eject port.

(6) An ink-jet recording apparatus comprising: a recovery means for executing recovery treatment respectively for a first eject port for ejecting first ink and a second eject port for ejecting second ink different from the first ink; and a measuring means for measuring elapsed time after the recovery means executes a most recent recovery treatment for the respective first eject port and second eject port; and a control means for causing the recovery means to execute recovery treatment for the first eject port and/or the second eject port which corresponding elapsed time measured by the measuring means exceeds respective predetermined threshold times peculiar to the respective first eject port and second eject port, and for clearing the elapsed time measured by the measuring means which corresponding eject port is recovered by the recovery means, where: the predetermined threshold time for the first eject port is set at nearly natural number times as long as the predetermined threshold time for the second eject port, the natural number being two or more.

(7) An ink-jet recording apparatus according to (6), where: the first eject ports is provided to a color head unit for ejecting color ink as the first ink and the second eject port is provided to a black head unit for ejecting black ink as the second ink.

(8) The ink-jet recording apparatus according to (6), where: the first ink includes dye as coloring material; and the second ink includes pigment as coloring material.

(9) The ink-jet recording apparatus according to (6), where: the recovery means executes recovery treatment when data for recording is received.

(10) An ink-jet recording apparatus according to (6), where: electro-thermal converting bodies for generating thermal energy to be utilized to eject ink are arranged correponding to the respective first eject port and second eject port.

DETAILED DESCRIPTION OF THE PREFERRED EMBODIMENTS

Hereinafter embodiments are explained in detail by referring to drawings.

Figure 1:
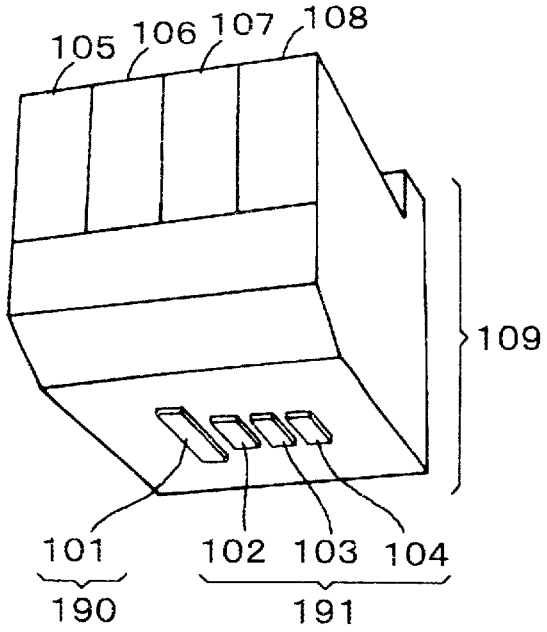
FIG. 1 is a perspective view showing an outline arrangement of an ink-jet head cartridge according to the present invention.
Figure 2:
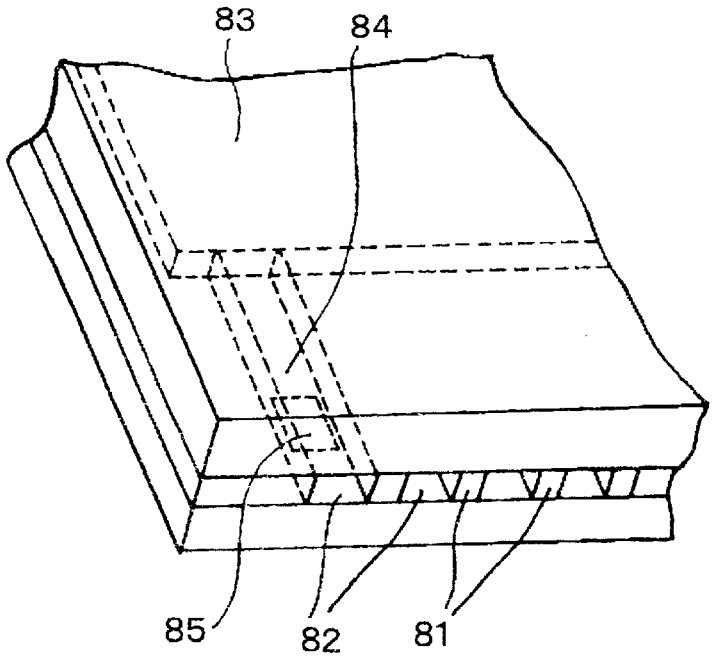
FIG. 2 is a partial perspective view schematically depicting a structure of eject portion of the recording head.

FIG. 1 is the perspective view showing the outline arrangement of the ink-jet head cartridge according to the present invention. FIG. 2 is a partial perspective view schematically depicting a structure of eject portion of the recording head. And FIG. 3 is the perspective view showing the outline arrangement of the ink-jet recording apparatus equipped with the ink-jet head cartridge according to the present invention.

In FIG. 1 reference numerals "101" to "104" are ink-jet heads from which inks are ejected by bubbles generated by thermal energy onto a printing medium. A reference numeral "190" is a black ink-jet head unit and "191" is a color ink-jet head unit where color ink-jet heads 102 to 104 are arranged as the unit. Reference numerals "105" to "108" are ink tanks for respective colors, black, cyan, magenta and yellow. A reference numeral "109" is an ink-jet cartridge where ink-jet heads 101 to 104 are combined into one-pieced part and respective ink tanks 105 to 108 are demountably mounted on the ink-jet cartridge 109.

FIG. 2 is the partial perspective view schematically depicting a structure of eject portion of the recording head. A plurality of eject ports 82 are formed by a predetermined pitch on eject port surface 81 facing against the medium to be recorded by a predetermined gap (for example, ca. 0.2 to ca. 0.3 mm). Electro-thermal energy conversion modules (exothermic resistance modules, heaters) 85 for generating energy to eject ink are arranged along walls of respective liquid paths 84 communicating a common liquid chamber 83 and respective eject ports 82 together. The ink-jet cartridge 109 is mounted on the carriage 216 in a way where a row of eject ports is positioned so as to cross a main scanning direction (a moving direction of the ink-jet cartridge and carriage). When electro-thermal energy conversion modules are driven (applied electricity), inks in liquid paths 84 are brought to a film boiling and are ejected from eject ports 82 by generated pressure from the film boiling.

Figure 3:
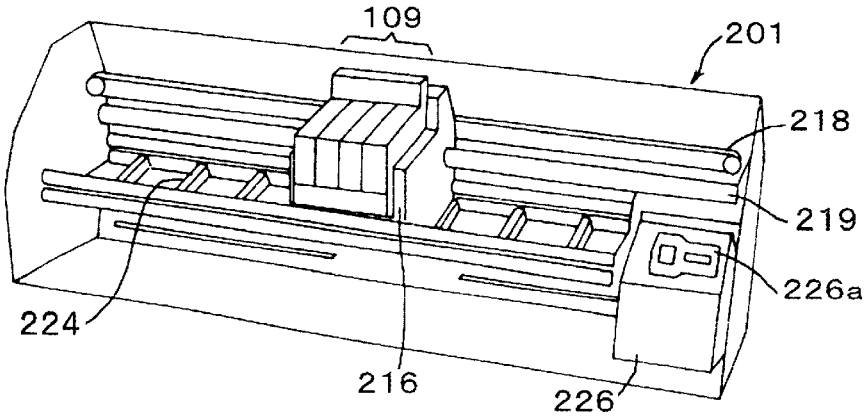
FIG. 3 is a perspective view showing an outline arrangement of an ink-jet recording apparatus equipped with the ink-jet head cartridge according to the present invention.

In FIG. 3 a reference numeral 201 is the ink-jet recording apparatus where the ink-jet cartridge is demountably mounted on the ink-jet recording apparatus. Ink tanks 105 to 108 where inks to be supplied to ink-jet heads 101 to 104 are reserved, comprise ink absorbents, containers where ink absorbents are inserted and covers for sealing the containers (these are not shown in FIG. 3). Inks are filled inside these ink tanks and are successively supplied to ink-jet heads 101 to 104 in accordance with ejected amounts of inks.

In FIG. 3 the reference numeral "109" is the ink-jet cartridge equipped with nozzle groups ejecting inks against a surface to be recorded of the recording medium fed onto a platen 224. A reference numeral "216" is a carriage connected to a part of a driving belt 218 for transmitting a driving force from a driving motor (not shown). The carriage 216 is arranged along a guide shaft 219 to move sliably so that the carriage can reciprocally move along the whole width of the recording medium to be recorded by ink-jet heads 101 to 104. Ink-jet heads 101 to 104 record an image on the recording medium in accordance with received data while the carriage moves reciprocally. The reciprocal movements of the ink-jet heads are called main scanning operations. The recording medium is transferred by a sub scanning operation so as to transfer the recording medium by a predetermined amount, whenever one main scanning operation is finished.

A reference numeral "226" is a head recovery device arranged at one end of a moving range of ink-jet heads 101 to 104, such as a home position. Ink-jet head units 190 and 191 are respectively capped as the head recovering device 226 is driven by a driving force from a motor via a transmitting mechanism. Eject recovery treatments to remove thickened inks and bubbles in eject ports are executed such that inks are forcibly discharged from eject ports through sucking (sucking recovery) operations by a sucking means (a sucking pump) arranged in the head recovering device 226, in accordance with capping movements over ink-jet head units 190 and 191 by a cap 226*a* of the head recovering device 226. Recording heads are protected by capping with the cap 226*a* when recording operations are finished. The above-mentioned eject recovery treatments are executed when sucking recovery treatments are not executed for a predetermined elapsed time, after the ink-jet head cartridge is exchanged and after ink tanks 105 to 108 are exchanged.

Figure 5:
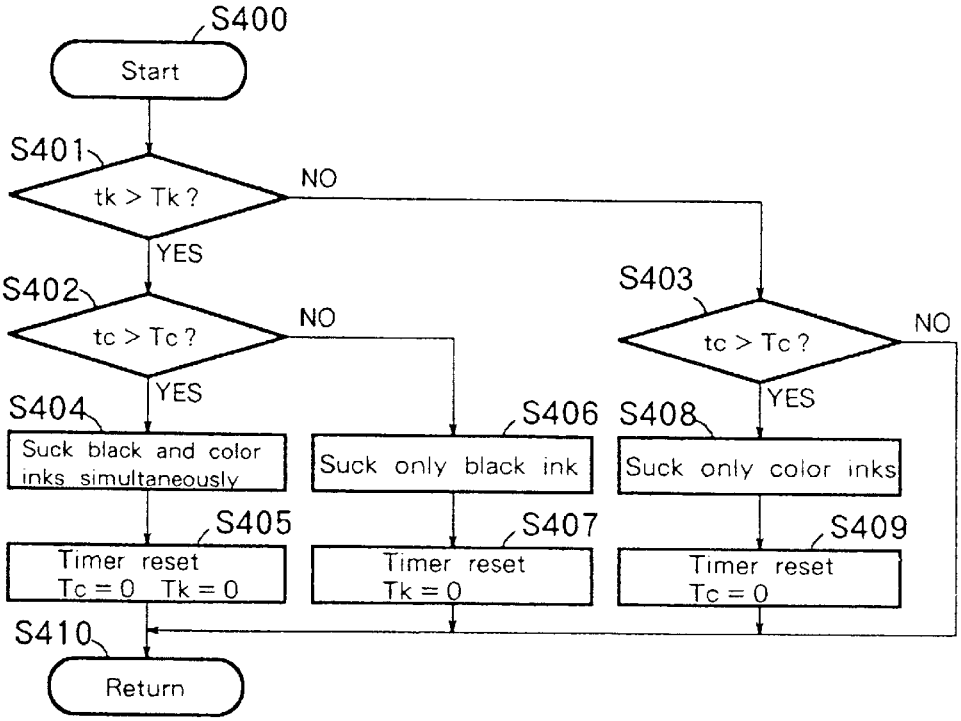
FIG. 5 is a flow chart showing a sequence of automatic sucking operations controlled by the timer.

The controlling sequence of the automatic sucking operations by the timer is explained by referring to FIG. 5.

A sucking history is checked when image data are transmitted to the recording apparatus (S400). An elapsed time tk after the previous black ink sucking operation is compared with a predetermined time Tk (S401). The time Tk is a critical elapsed time which allows ink to be ejected properly by an ejecting force of the ink-jet head 101 under a condition where nozzles are apt to stuck easily or bubbles are grown at a highest rate. If the elapsed time tk exceeds the predetermined time Tk, the sucking recovery operation is required so that the sequence goes to step S402. At step S402, an elapsed time tc after the previous color ink sucking operation is compared with a predetermined time Tc. The time Tc is also a critical elapsed time which allows inks to be ejected properly by ejecting forces of the ink-jet heads 102 to 104 under a condition where nozzles are apt to stuck easily or bubbles are grown at a highest rate. If the elapsed time tc exceeds the predetermined time Tc, the sucking recovery operation is required so that the sequence goes to step S404, sucking operations of black and color inks are executed simultaneously and the sequence goes to step S405. In step S405, elapsed times tk and tc in the timer are set at zero (tk=0, Tc=0), thus the sucking sequence is finished. If the elapsed time tc does not exceed Tc in step S402, which means the sucking recovery operation is required only for the black ink, the sucking recovery operation only of the black ink is executed (step S406). And at step S407 the elapsed time tk for the black ink is set at zero (tk=0), thus the sucking sequence is finished. If the elapsed time tk does not exceed Tk at step S401, which means the sucking recovery operation is not required in the black ink, the elapsed time tc is compared with Tc in step S403. If the time tc does not exceed Tc, the sucking sequence is finished. If the time tc exceeds Tc, which means the sucking recovery operation is required only in color inks, the sucking recovery operation only for color inks is executed (step S408). And at step S409 the elapsed time tc of color inks is set at zero (tc=0), thus the sucking sequence is finished. When the above-mentioned respective sucking recovery operations are finished the sucking recovery sequence goes to step S410, a standby status preceding the next sucking recovery operation.

Figure 4:
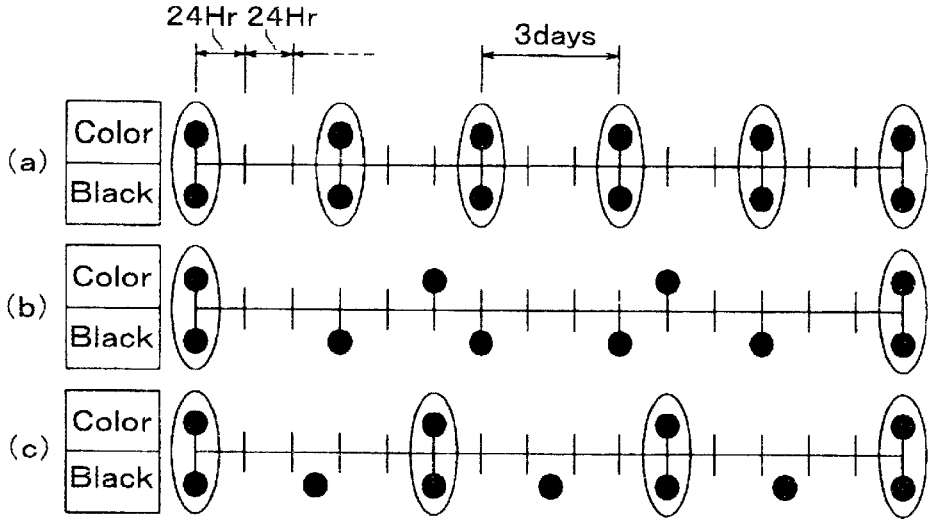
FIG. 4 shows charts explaining timings of sucking operations against black and color inks controlled by the timer in the conventional ink-jet recording apparatus and in the present invention.

In FIG. 4, (a) to (c) are charts explaining sucking operations where timings of sucking operations for respective black and color inks controlled by the timer are depicted.

One division of horizontal axes in these charts represents 24 hours. These charts are showing all sucking recovery operations controlled by the timer are executed at count up timings, consequently, maximum sucking recovery operations by the timer are executed. In FIG. 4, (a) shows conventional sucking schedule controlled by the timer. As seen from the chart, since only one threshold value for executing sucking operations is set at 72 hours, black and color inks are sucked simultaneously every three days. Provided that a critical time before sucking the black ink is decide at 72 hours and that for color inks is decided at 120 hours through experiments, sucking operations for the black ink is sucked by the timer at just the critical threshold timing while sucking operations for color inks are executed by the timer more frequently than required.

In FIG. 4, (b) shows sucking schedule according to the present invention where threshold values for black and color inks are set at different values. The threshold value Tk for executing sucking operation against the black ink is set at 72 hours and the threshold value Tc for executing sucking operations against color inks is set at 120 hours based on the results of the experiments. Compared with the conventional case shown in (a) of FIG. 4, the frequency of sucking recovery operations against color inks are reduced to 3/5 times of the conventional case, while the frequency of sucking recovery operations against the black ink remains at the same frequency as the conventional case. Thus wasted volume of color inks is suppressed due to frequent sucking operations. However, an overall frequency of sucking operations during 360 hours is 7 comprising 4 sucking operations against only black ink, 2 sucking operations against only color inks and 1 simultaneous sucking operation against black and color inks (the sucking operation at the starting point is excluded). In this case 7/5 sucking operations are executed compared with 5 simultaneous sucking operations against black and color inks depicted in (a) of FIG. 4. Sucking recovery operations by the timer are executed when the recording apparatus receives data before printing operations are started. Consequently, the frequent sucking recovery operations make a user feel a lowered printing throughput.

In FIG. 4, (c) shows sucking schedule according to the present invention where threshold values for black and color inks are set at different values. The threshold value Tc for executing sucking operations against the color inks is set m (where m is a natural number more than 2) times of the threshold value Tk for executing sucking operations against black ink, namely Tc=Tk×m. In this case, since the threshold values for the black ink and color inks are respectively set at 60 hours and 120 hours, the black ink is sucked whenever sucking recovery operations against color inks are executed by the timer. Due to set threshold values in this way, the frequency of sucking recovery operations against the black ink is a little bit increased to 6/5 times of the conventional case, while the frequency of sucking recovery operations against color inks is much decreased to 3/5 times of the conventional case. This suppresses wasted volume of inks during sucking operations. An overall frequency of sucking operations during 360 hours is 6 comprising 3 sucking operations against only black ink and 3 simultaneous sucking operation against black and color inks (the sucking operation at the starting point is excluded). This is less than the case of (b) in FIG. 4 where 7 sucking operations comprising 4 sucking operations against only black ink, 2 sucking operations against only color inks and 1 simultaneous sucking operation against black and color inks, are executed so that a felt printing throughput by the user is kept from lowering and at the same time wasted volume of inks is suppressed.

Threshold values are set n times of the least threshold value, here n is a natural number not less than precisely two. But nearly two is also acceptable, here "nearly" means a difference between the natural number falls into an allowable error limit. In these embodiments the pump is used as sucking recovery means, but any means which can forcibly discharge inks from the ink-jet head such as a pressurizing means and the like, can be used as the sucking recovery means. In the above-described embodiments inks with different properties i.e. the black ink containing a pigment as a coloring material and color inks containing dyes as color materials, but any combinations of inks with different critical times before sucking such as a combination of an ink containing a dye and an image fixing liquid ejected from the ink-jet head for fixing the ink can be used in the present invention. The present invention is also applicable to a case where inks themselves have the same critical times before sucking, but virtually the times are different each other due to structural differences among tanks and ink-jet heads. In the above-mentioned embodiments cases of two critical times are explained, but a case having more than three threshold times according to critical times is also employable if respective heads can be recovered. The threshold values, for example T1, T2, T3 . . . arranged in order from smallest value, may be set as follows: T2=T1×m, T3=T1×n where m and n are natural number not less than two.

As explained above, in the image recording apparatus equipped with two or more head units or heads having different critical times which means maximum allowable time to keep ink ejection by ejecting force of the ink-jet print heads in normal states under a condition where inks having different properties are hard to eject inks, one head unit/head and other head unit/head have respective threshold values for executing sucking recovery operations controlled by the timer and further threshold value T2 for other head unit/head is set a natural number (two or more) times of threshold value T1 of one head unit/head, thus an ink-jet recording head which can suppress wasted volume of inks, can be provided and also frequency of recovery treatments can be kept from increasing. In addition circuit design for controlling recovery operations can be also simplified by employing the present invention.

What is claimed is:

1. An ink-jet recording apparatus comprising:

a recovery device for executing recovery treatment respectively for a first eject port for ejecting first ink and a second eject port for ejecting second ink different from the first ink; and a control means for causing said recovery device to execute recovery treatment for said first eject port and/or said second eject port which an elapsed time after said recovery device executes a most recent recovery treatment exceeds respective predetermined threshold times peculiar to respective said first eject port and said second eject port, wherein:

the predetermined threshold time for said first eject port is set at nearly integral times as long as the predetermined threshold time for said second eject port, the integral being two or more.

2. The ink-jet recording apparatus according to claim 1 wherein:

said first eject port is provided to a color head unit for ejecting color ink as the first ink; and said second eject port is provided to a black head unit for ejecting black ink as the second ink.

3. The ink-jet recording apparatus according to claim 1 wherein:

the first ink includes dye as coloring material; and the second ink includes pigment as coloring material.

4. The ink-jet recording apparatus according to claim 1, wherein:

said recovery means executes recovery treatment when data for recording is received.

5. The ink-jet recording apparatus according to claim 1 wherein:

electro-thermal converting bodies for generating thermal energy to be utilized to eject ink are arranged corresponding to respective said first eject port and said second eject port.

6. An ink-jet recording apparatus comprising:

a recovery device for executing recovery treatment respectively for a first eject port for ejecting first ink and a second eject port for ejecting second ink different from the first ink; and a measuring means for measuring elapsed time after said recovery device executes a most recent recovery treatment for respective said first eject port and said second eject port; and a control means for causing said recovery device to execute recovery treatment for said first eject port and/or said second eject port which an elapsed time measured by said measuring means exceeds respective predetermined threshold times peculiar to respective said first eject port and said second eject port, and for clearing the elapsed time measured by said measuring means which corresponding eject port is recovered by said recovery device, wherein:

the predetermined threshold time for said first eject port is set at nearly integral times as long as the predetermined threshold time for said second eject port, the integral being two or more.

7. An ink-jet recording apparatus according to claim 6 wherein:

said first eject port is provided to a color head unit for ejecting color ink as the first ink; and said second eject port is provided to a black head unit for ejecting black ink as the second ink.

8. The ink-jet recording apparatus according to claim 6 wherein:

the first ink includes dye as coloring material; and the second ink includes pigment as coloring material.

9. The ink-jet recording apparatus according to claim 6, wherein:

said recovery means executes recovery treatment when data for recording is received.

10. An ink-jet recording apparatus according to claim 6 wherein:

electro-thermal converting bodies for generating thermal energy to be utilized to eject ink are arranged corresponding to respective said first eject port and said second eject port.

11. A method for performing recovery in an ink-jet recording apparatus, the method comprising the steps of:

executing recovery treatment respectively for a first eject port for ejecting first ink and a second eject port for ejecting second ink different from the first ink; and measuring elapsed time after execution of a most recent recovery treatment for respective said first eject port and said second eject port; and controlling to cause execution of recovery treatment for said first eject port and/or said second eject port for which a measured elapsed time exceeds respective predetermined threshold times peculiar to respective said first eject port and said second eject port, and to clear the measured elapsed time which corresponds to the eject port that is recovered by said execution of recovery treatment, wherein:

the predetermined threshold time for said first eject port is set nearly integral times as long as the predetermined threshold time for said second eject port, the integral being two or more.

* * * * *

UNITED STATES PATENT AND TRADEMARK OFFICE

CERTIFICATE OF CORRECTION

PATENT NO. : 6,669,326 B2
DATED : December 30, 2003
INVENTOR(S) : Yazawa et al.

It is certified that error appears in the above-identified patent and that said Letters Patent is hereby corrected as shown below:

Column 1,
Line 13, “some” should read -- some- --.
Line 21, “few” should read -- low --.
Line 25, “decide” should read -- determined --.
Line 26, “being” should be deleted.
Line 39, “apt” should read -- is apt --.
Line 58, “where:” should read -- wherein --.
Line 64, “”where:” should read -- wherein -- and “provide” should read -- provided --.

Column 2,
Lines 2, 5, 8, 25, 37, 40 and 43, “where:” should read -- wherein --.
Line 31, “where:” should read -- wherein -- and “ports” should read -- port --.
Line 45, “correponding” should read -- corresponding --.

Column 3,
Line 53, “sliably” should read -- slidably --.

Column 4,
Lines 24 and 32, “stuck” should read -- eject --.

Column 5,
Line 55, “operation” should read -- operations --.
Line 65, “here” should read -- where --.

Column 6,
Line 13, “different” should read -- different from --.

Signed and Sealed this

Twenty-eighth Day of December, 2004

JON W. DUDAS
*Director of the United States Patent and Trademark Office*